United States Patent [19]

Barbarow

[11] 4,093,233

[45] June 6, 1978

[54] GOLF GAME

[76] Inventor: Charles E. Barbarow, 147 Greene Ave., Totowa, N.J. 07512

[21] Appl. No.: 763,497

[22] Filed: Jan. 28, 1977

[51] Int. Cl.[2] ..... A63B 67/02; A63B 3/04

[52] U.S. Cl. ..... 273/176 A; 273/176 L; 273/181 R; 273/184 A; 273/245

[58] Field of Search ..... 273/87 R, 87 C, 134 B, 273/134 CB, 134 CG, 127 R, 127 B, 177 R, 181 R, 184 R, 184 A, 176 A, 176 B, 176 L; 272/102, 103, 104

[56] References Cited

U.S. PATENT DOCUMENTS

| | | | |
|---|---|---|---|
| 1,736,523 | 11/1929 | Decker | 273/134 CG UX |
| 1,892,593 | 12/1932 | Stiles | 273/177 R X |
| 1,902,995 | 3/1933 | Flynn | 272/103 X |
| 2,248,053 | 7/1941 | Bales | 273/176 L UX |
| 3,384,367 | 5/1968 | Baum | 272/103 |
| 3,801,096 | 4/1974 | Miller | 272/102 |
| 4,010,957 | 3/1977 | Tricoli | 273/134 B X |

FOREIGN PATENT DOCUMENTS

| | | | |
|---|---|---|---|
| 689,523 | 6/1964 | Canada | 272/103 |
| 657,018 | 9/1951 | United Kingdom | 273/134 CB |

*Primary Examiner*—Anton O. Oechsle
*Attorney, Agent, or Firm*—Samuelson & Jacob

[57] ABSTRACT

A golf game in which the player strikes a golf ball into a scoring field having a plurality of scoring zones and including a board having a representation of a golf course with a prescribed number of spaces between the tee and the cup of each hole. A movable playing piece represents a player's position on the course and is moved in response to the position of the struck ball on the scoring field to a space on the golf hole being played. Certain spaces are provided with specially marked indicia of two types for the selection of an instruction card from the designated stack of such cards associated with the particular specially marked space to further determine the movement of the player's playing piece.

12 Claims, 5 Drawing Figures

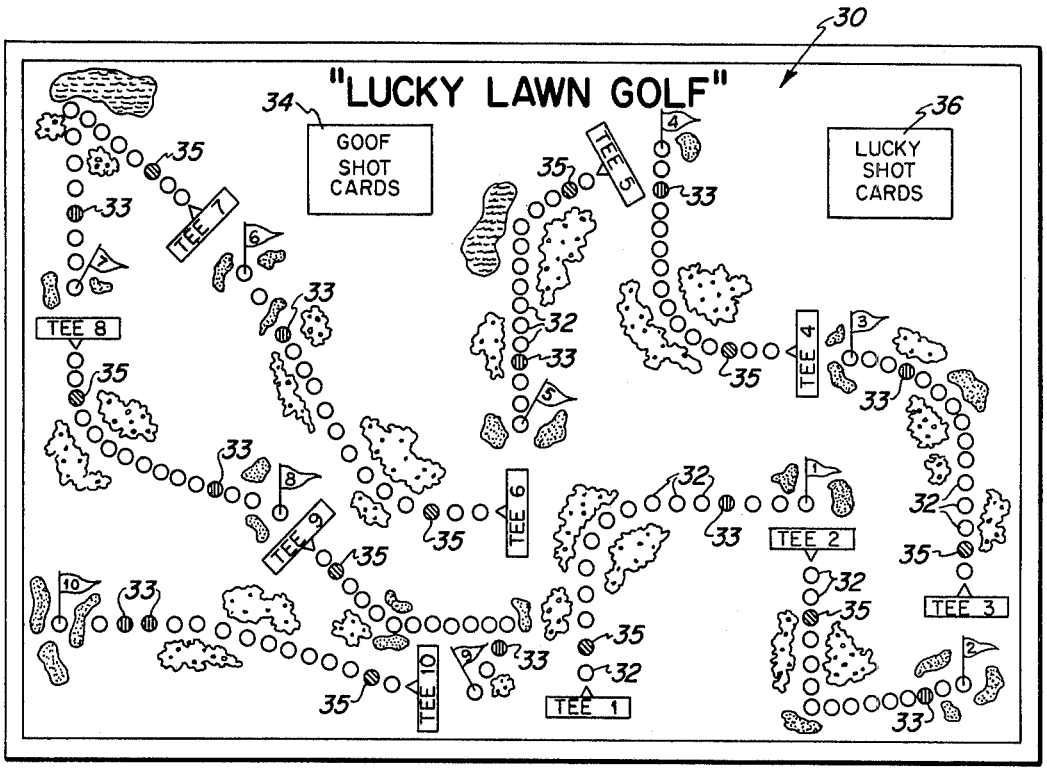
FIG. 3
38
OOPS!!
YOU JUST LANDED IN A SAND TRAP.
MOVE YOUR PLAYING PIECE BACK FOUR SPACES.
40
NOW THAT'S WHAT YOU CALL LUCK, YOUR BALL JUST RICOCHETED OFF A TREE AND WENT AN ADDITIONAL TWENTY FEET.
ADVANCE YOUR PLAYING PIECE SEVEN SPACES.
FIG. 4
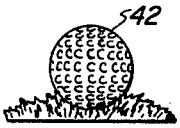
FIG. 5

GOLF GAME

The invention relates to a golf game in which the player plays a simulated golf game by striking a golf ball from a predetermined position on the ground toward a pair of spaced apart scoring stands. The position of the struck ball with respect to the scoring stands after the ball comes to rest determines the movement of a playing piece on a board having a representation of a golf course thereon.

In particular, the invention is directed toward providing a game in which the skill of playing the game of golf is combined with the competition engendered by the chance inherent in the board portion of the game.

The prior art golf games, as well as those which simulate other games, are largely dependent on a chance mechanism to determine the number of spaces which are to be moved on the board. Such chance mechanisms may be dice, spinning pointers, flipped cards or similar devices.

Broadly, the instant invention combines the player's skill in striking a golf ball the desired distance to achieve the maximum benefit from the movement of the playing piece on the board. The board has a representation of a golf course with representations of a plurality of golf holes. Each such hole has a number of spaces between the representation of a tee and the representation of a cup. Certain of the spaces have indicia, preferably one of two colors, marked thereon. When a playing piece lands on one of the colored spaces, the player draws a card from an associated stack of instruction cards to determine a further move of the playing piece.

It can readily be seen that an important object of the invention is to combine the skill in making golf shots with the chance inherent in a board game.

It is a further object of the invention to provide target means to measure the accuracy of a golf shot.

It is yet another object of the invention to provide a scoring field having a plurality of scoring zones for determining the movement of a playing piece on the board.

It is a still further object of the invention to provide a pair of scoring stands which are located at the lateral edges of the scoring field to provide the target area at which the player's golf shot is directed.

These and other objects, advantages, features and uses will be apparent during the course of the following description, when taken together with the accompanying drawing, wherein:

FIG. 3 is a plan view of a game board which may be used in connection with the scoring stands of FIGS. 1 and 2;

FIG. 4 is a view of one of the penalty cards and one of the bonus cards used with the game board of FIG. 3; and FIG. 5 is an elevational view of a playing piece used to mark a player's position on the board.

Figure 1:
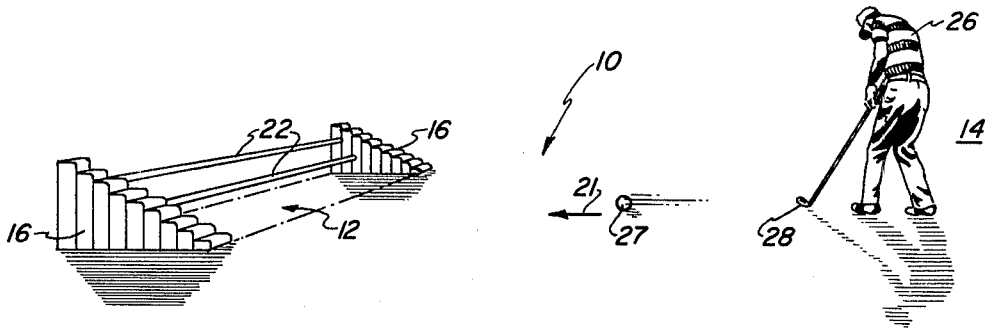
FIG. 1 is an elevational view showing a player making a golf shot toward the scoring field target area of a preferred embodiment of the invention.

In the drawing, wherein, for the purpose of illustration, there is shown a preferred embodiment of the scoring stands and a preferred embodiment of the game board and the materials associated therewith, the numeral 10 designates a playing surface, generally.

Figure 2:
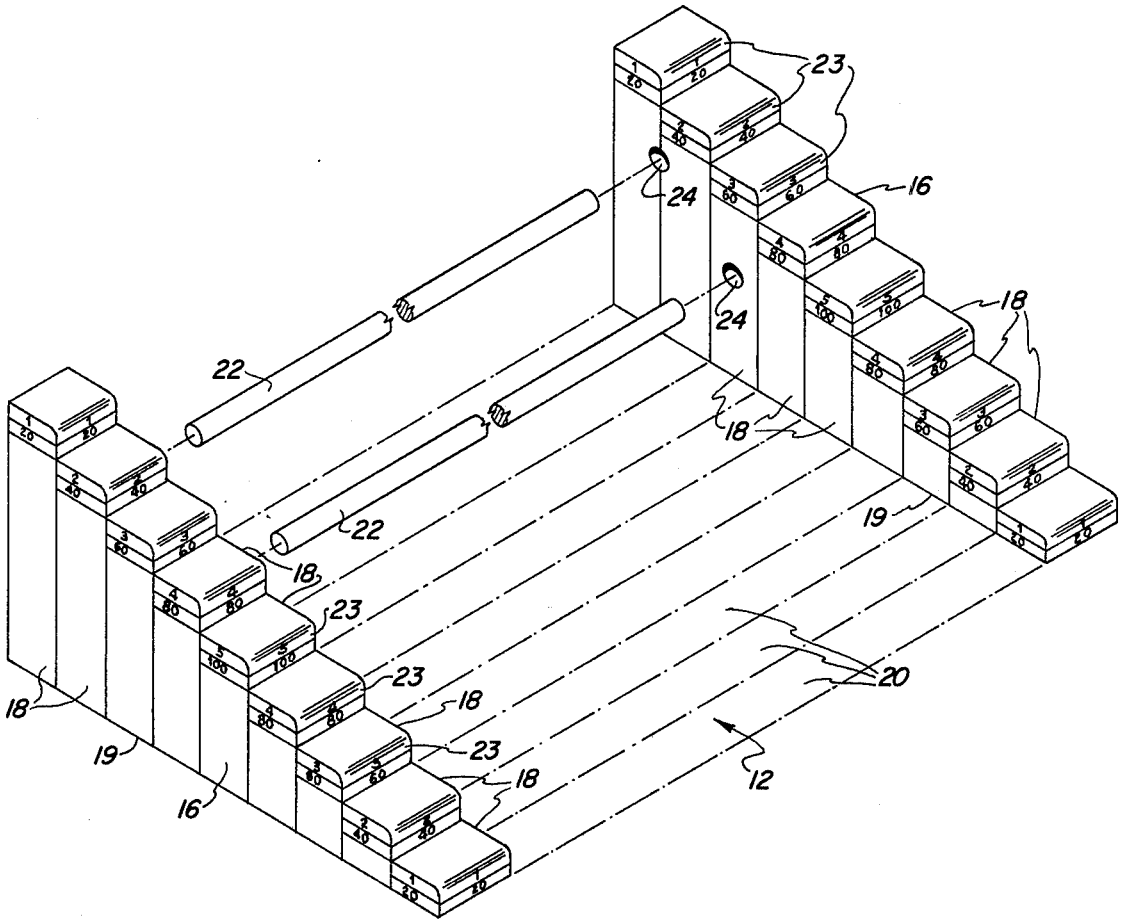
FIG. 2 is an isometric view showing the construction of the scoring stands with the scoring field and its scoring zones defined therebetween.

Playing surface 10 is seen to include a scoring field 12 and a predetermined position 14 from which the ball is driven to be propelled toward the scoring field 12, the scoring columns 18 being illustrated in the form of delineated areas on confronting surfaces of the pair of scoring stands, as seen in FIG. 2. The scoring field 12 is defined by a pair of scoring stands 16 which are placed on the ground, or other horizontal area which makes up the playing surface, in a laterally spaced-apart relationship. Each scoring stand 16 has a plurality of scoring columns 18 of different height. Each scoring column 18 is marked with numerical indicia, those columns of the same height having the same indicia appearing thereon. Scoring stands 16 each have a base 19 and the scoring columns 18 extend upwardly from the base of each scoring stand, while being located longitudinally side-by-side relative to one another. The scoring stands 16 each have a finite lateral width, and each includes a stepped configuration wherein each subsequent consecutive scoring column 18, as viewed in the longitudinal direction away from predetermined position 14 and toward the scoring field 12, as indicated by arrow 21 in FIG. 1, extends upwardly one step further than the next previous scoring column 18 to establish a plurality of consecutive steps 23 of finite width. Numerical indicia are placed on the front face of steps 23 so as to facilitate reading the score from the predetermined position 14.

The scoring field 12 lies between scoring stands 16 and is divided into a plurality of scoring zones 20 as defined by the areas extending laterally between the scoring columns 18, the purpose of which will become apparent as this description proceeds. The scoring stands 16 are held in position relative to one another by bracing means in the form of a pair of support rods 22 which fit into openings 24 in the scoring stands 16 to be affixed to the scoring stands. Scoring stands 16 preferably are constructed of a relatively lightweight material, such as a foamed plastic, which provides the appropriate size and configuration without excessive weight. The dimensions and spacing of the scoring stands 16, and interconnecting support rods 22, enable the use of a full-size golf ball driven from a full-size golf tee by a full-size golf club, all as will now be explained.

A preferred manner of using this portion of the invention is to play lawn golf as follows. A tee area is defined and designated at the predetermined position 14 and a player 26 strikes a ball 27 with a golf club 28 to propel the ball toward the scoring field 12. If the ball 27 comes to rest between the scoring stands 16, the player is credited with the number corresponding to the scoring zone 20 on which the major portion of the ball is resting.

Assume that the ball is resting on the scoring zone 20 running between the columns 18 marked "3/60." Then, the player would be credited with sixty points. To make the game competitive and interesting, each player strokes three balls toward the scoring area and the score is not counted until all three balls are hit since a subsequently struck ball might hit a previous ball either onto or out of the scoring area.

After the score reaches a certain amount, say 300 or any subsequent higher value, the tee area is moved to make the golf shots more difficult and increase the interest in the game. The game is over and a winner is declared when all the players have had their turns and one of them has scored 500 or 1000, whatever winning score has been agreed upon before the game began.

One may also use the scoring zones on the above described portion of the invention to play a game on a game board 30, which I call "Lucky Lawn Golf." The board 30 contains a representation of ten holes of a golf course. Each hole has a representation of a golf tee, as designated "TEE 1", "TEE 2", etc., and a representation of a golf cup designated with a flag with the hole number thereon. The golf holes are numbered consecutively and are located on different areas of the board, with the relative location of the holes being such that the cup of each hole is located adjacent the tee of the next subsequent hole.

Between the tee and the cup representations there are a plurality of spaces 32 depicting an incremental path of travel through each hole. At least one of the spaces on each hole is color-coded by being marked in red and another is color-coded by being marked in green. The red spaces 33 are designated "goof shots" and if a player lands on such a space, he draws a penalty card from a stack of goof shot cards which are piled face down on the area 34 marked "goof shot cards."

If the player lands on a green space 35, he draws a bonus card from the area 36 which is marked "lucky shot cards." A typical "lucky shot" card 40 and a typical "goof shot" card 38 are illustrated in FIG. 4.

A molded playing piece 42, which is moved on board 30 in accordance with the rules of the game, is illustrated in FIG. 5. Different players will use playing pieces of different colors.

It remains to combine the player-operated scoring device of FIGS. 1 and 2 and the game board of FIG. 3 to make a very interesting game which has elements of both skill and chance.

The player 26 strikes a ball 27 which rolls into the scoring field 12, for example, the major portion of the ball is between scoring columns 3/60. He, therefore, moves his playing piece 42 three increments by moving three spaces 32. If he lands on a "goof shot" space 33 of a "lucky shot" space 35, he takes the top card from the appropriate stack and follows the instructions on the card. Ordinarily, a "lucky shot" card 40 contains a bonus instruction which includes an instruction to move the player's playing piece forward, in the direction from the tee toward the cup, a prescribed number of spaces. Likewise, a "goof shot" card 38 ordinarily contains a penalty instruction to move the player's playing piece backward, in the direction from the cup to the tee, a prescribed number of spaces.

It can readily be seen that a skilled player will attempt to avoid a "goof shot" space by checking the position of his playing piece and hitting his ball so that his space count will avoid the "goof shot" space. To make the game even more interesting, some of the "lucky shot" cards may contain penalties and some of the "goof shot" cards may contain bonuses.

While particular embodiments of the invention have been shown and described, it is apparent to those skilled in the art that modifications are possible without departing from the spirit of the invention or the scope of the subjoined claims.

The embodiments of the invention in which an exclusive property or privilege is claimed are defined as follows:

1. A board game in which a player plays a simulated golf game, the board game comprising:

a playing board having a golf course representation thereon;

a plurality of golf hole representations located in different areas of the golf course representation on the playing board;

a golf tee location representation on the board associated with each golf hole representation;

a golf cup location representation on the board associated with each golf hole representation and spaced from the corresponding golf tee location representation;

a prescribed number of spaces marked on the playing board between the golf tee location representation and the golf cup location representation of each golf hole representation for depicting an incremental path of travel through each golf hole representation;

a movable playing piece for representing the player's position on the golf course representation; and a player-operated device for determining the number of increments of advancement of the playing piece along the path of travel of a golf hole representation in response to an operation of the player-operated device by the player whose position is represented by that playing piece, the player-operated device comprising a pair of scoring stands for placement upon a playing surface in laterally spaced-apart relationship, each scoring stand including a base; and a plurality of scoring columns extending along each scoring stand upwardly from the base thereof and located longitudinally along each scoring stand for defining a corresponding plurality of scoring zones within a scoring field extending along the playing surface between the scoring columns on the pair of scoring stands;

each scoring stand having a finite lateral width and including a stepped configuration wherein each subsequent consecutive scoring column, as viewed in the longitudinal direction away from the predetermined position on the playing surface and toward the scoring field, extends upwardly one step further than the next previous scoring column to establish a plurality of consecutive steps of finite width; and scoring indicia placed on each step for identifying the score corresponding to each scoring column;

the laterally spaced-apart relationship being such that a ball is capable of being rolled between the scoring stands, in a longitudinal direction, from a predetermined position on the playing surface located away from the scoring field, in response to operation of the device by the player, to come to rest in one of the scoring zones, whereby the score corresponding to said one of the scoring zones determines the number of increments of advancement of the player's playing piece for that operation of the player-operated device.

2. The invention of claim 1 including a plurality of instruction cards for placement upon the playing board and wherein certain ones of the spaces marked on the board are designated for the selection of one of said instruction cards by a player whose playing piece is moved to any of said designated ones of the spaces.

3. The invention of claim 2 wherein:

the instruction cards are divided into first and second types;

the first type card carrying a bonus instruction and being known as a "lucky shot" card;

the second type card carrying a penalty instruction and being known as a "goof shot" card; and the playing board includes first and second further areas, each further area being designated for a stack of cards of one type.

4. The invention of claim 3 wherein the designated ones of the spaces are color-coded to denote which of the first and second types of instruction card must be selected.

5. The invention of claim 3 wherein:

each bonus instruction includes an instruction to move the corresponding playing piece forward, in the direction from the golf tee location representation toward the golf cup location representation, a prescribed number of increments; and each penalty instruction includes an instruction to move the corresponding playing piece backward, in the direction from the golf cup location representation toward the golf tee location representation, a prescribed number of increments.

6. The invention of claim 1 wherein the golf hole representations are numbered consecutively and are located on the board relative to one another such that the golf cup location representation of each golf hole representation is located adjacent the golf tee location representation of the next subsequent golf hole representation.

7. The invention of claim 6 wherein the number of golf hole representation is ten.

8. The invention of claim 1 including bracing means extending between the pair of scoring stands and affixed thereto, the bracing means being spaced upwardly away from the scoring field.

9. The invention of claim 1 wherein the ball is a full-size golf ball and the predetermined position comprises a full-size golf tee location, whereby the player can operate the scoring device by locating the full-size golf ball at the full-size golf tee location and striking the ball with a full-size golf club.

10. In a golf ball game apparatus, the improvement comprising:

a pair of scoring stands for placement upon a playing surface in laterally spaced-apart relationship, each scoring stand including a base; and a plurality of scoring columns extending along each scoring stand upwardly from the base thereof and located longitudinally along each scoring stand, the scoring columns including corresponding delineated areas on confronting surfaces of the pair of scoring stands for defining a corresponding plurality of scoring zones within a scoring field extending along the playing surface between the scoring columns on the pair of scoring stands;

each scoring stand having a finite lateral width and including a stepped configuration wherein each subsequent consecutive scoring column, as viewed in the longitudinal direction away from the predetermined position on the playing surface and toward the scoring field, extends upwardly one step further than the next previous scoring column to establish a plurality of consecutive steps of finite width; and scoring indicia placed on each step for identifying the score corresponding to each scoring column and each delineated area thereof.

11. The invention of claim 10 including bracing means extending between the pair of scoring stands and affixed thereto, the bracing means being spaced upwardly away from the scoring field.

12. The invention of claim 10 wherein the predetermined position is a golf tee location, whereby the player can locate the golf ball at the golf tee location and can propel the golf ball by striking the golf ball with a golf club.

* * * * *